US008167416B2

(12) United States Patent
Ohashi et al.

(10) Patent No.: US 8,167,416 B2
(45) Date of Patent: May 1, 2012

(54) LIQUID CONTAINER

(75) Inventors: Tetsuya Ohashi, Matsudo (JP); Yasuo Kotaki, Yokohama (JP); Koichi Kubo, Yokohama (JP); Tatsuo Nanjo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 572 days.

(21) Appl. No.: 12/362,393

(22) Filed: Jan. 29, 2009

(65) Prior Publication Data

US 2009/0189963 A1 Jul. 30, 2009

(30) Foreign Application Priority Data

Jan. 29, 2008 (JP) ..... 2008-017838

(51) Int. Cl.
*B41J 2/175* (2006.01)

(52) U.S. Cl. ..... 347/86

(58) Field of Classification Search ..... 347/85–87
See application file for complete search history.

(56) References Cited

U.S. PATENT DOCUMENTS

| | | | |
|---|---|---|---|
| 6,196,669 | B1 | 3/2001 | Harvey et al. |
| 6,250,751 | B1 | 6/2001 | Whitney |
| 2004/0135854 | A1 | 7/2004 | Kuwabara et al. |
| 2004/0196341 | A1 | 10/2004 | Ogura et al. |

FOREIGN PATENT DOCUMENTS

| | | | |
|---|---|---|---|
| JP | 2002-355988 | | 12/2002 |
| JP | 2005-255196 | * | 3/2007 |
| JP | 2007-062335 | | 3/2007 |

* cited by examiner

*Primary Examiner* — Geoffrey Mruk
(74) *Attorney, Agent, or Firm* — Canon USA Inc IP Division

(57) ABSTRACT

A liquid container includes a housing having a supply port leading out liquid contained in the housing, a spring member configured to generate a negative pressure, a flexible member joined to the housing to form a liquid chamber, a plate member disposed between the flexible film and the spring member, a lid member configured to cover the flexible member and secured to the housing, and a rib member movably disposed in a space surrounded by the lid member and the flexible member and configured to regulate the shape of the flexible member and the position of the plate member.

17 Claims, 9 Drawing Sheets

LIQUID CONTAINER

BACKGROUND OF THE INVENTION

1. Field of the Invention

The present invention relates to liquid containers for storing liquids for use in inkjet recording. Examples of the liquids include an ink containing a coloring material, such as a dye or pigment, and a functional liquid for enhancing characteristics of printing results. The present invention further relates to liquid containers for storing liquids (including an ink) not only for use in inkjet recording but for various recording apparatuses.

The present invention is applicable to liquid containers for general printing apparatuses, copiers, facsimiles having a communication system, word processors having a printing unit, and industrial recording apparatuses compositely combined with various processing apparatuses.

2. Description of the Related Art

A known type of inkjet recording apparatus includes an inkjet head, an ink tank connected to the inkjet head and storing ink to be ejected, and a carriage on which the inkjet head and the ink tank are mountable. For recording, the inkjet recording apparatus ejects ink droplets from fine nozzles of the inkjet head onto a recording medium while causing the carriage and the recording medium to move relative to each other, thereby achieving desired recording.

An ink tank for such a recording apparatus (printer) has a negative pressure generating mechanism for generating a negative pressure for the inkjet head. The negative pressure generated by the negative pressure generating mechanism is sufficiently high to balance with a retaining force of an ink meniscus formed at an ink ejecting part of the inkjet head, and thus to prevent ink leakage from the ink ejecting part. The negative pressure is set at a level which allows a sufficient supply of ink for an ink ejecting operation of the inkjet head.

An example of the negative pressure generating mechanism is one in which a porous or fibrous member to be impregnated with ink is disposed in the ink tank so that an appropriate negative pressure is generated by an ink retaining force of the porous or fibrous member. Another example of the negative pressure generating mechanism is one in which an ink containing bag is formed of an elastic member (e.g., rubber member) having tension in a direction in which the volume of the ink containing bag increases and thus, a negative pressure is applied to ink by drag resulting from deformation of the elastic member caused by ink consumption. Still another example of the negative pressure generating mechanism is one in which a bag-like member is formed of a flexible film (flexible sheet body), an elastic structure (e.g., spring) capable of biasing the bag-like member in a direction in which the capacity of the bag-like member increases is disposed inside or outside the bag-like member, and thus a negative pressure is generated (see, e.g., U.S. Pat. No. 6,250,751).

As an example of the configuration of the ink tank formed of a flexible film and having a spring member as a mechanism for generating a negative pressure, a configuration disclosed in Japanese Patent Laid-Open No. 2007-062335 is also known. The disclosed configuration of the ink tank will be described with reference to FIG. 10.

FIG. 10 is a cross-sectional view schematically illustrating a configuration of an ink tank. The ink tank of FIG. 10 has a thin flat main body having one wall (first wall), the other wall (second wall) opposite the first wall, and a side wall connecting the first and second walls. The main body includes a housing 5 and a lid member 4. The housing 5 has an opening on the first wall's side and a supply port for leading out liquid (ink) from inside. The lid member 4 is joined to the opening of the housing 5 and has an air communication port 21. A flexible member 3 joined to the opening of the housing 5 is disposed inside the ink tank. The flexible member 3 and the second wall of the main body define a space for storing ink therebetween. A spring member 1 for generating a negative pressure and a plate member 2 are disposed in the space defined by the housing 5 and the flexible member 3. The plate member 2 is disposed between the flexible member 3 and the spring member 1. The lid member 4 is integral with a rib 7 for regulating movement of the plate member 2 displaced in accordance with ink consumption.

In the ink tank of this type, it is desirable that the flexible member 3 and the housing 5 be made of the same polymer material. An enclosed structure, except for the supply port, of the ink tank is thus formed by thermal welding. An opening of the supply port is one for generating a meniscus force which does not allow air to be taken in by negative pressure from the spring member 1. For example, a mesh filter having such a meniscus force is secured to the opening of the supply port.

The plate member 2 disposed between the spring member 1 and the flexible member 3 is in contact with the flexible member 3 in a large area. This allows stable displacement of the flexible member 3. The spring member 1 and the plate member 2 are secured to each other by swaging, welding, or the like to prevent positional displacement therebetween.

The ink tank having the above-described configuration is mounted onto a printer in a direction orthogonal to the biasing direction of the spring member 1 such that the supply port faces downward during use (i.e., in the direction of gravity indicated by arrow "g" of FIG. 10). Therefore, the plate member 2 is affected by gravity. Additionally, since the ink tank is mounted on a carriage, the ink tank undergoes acceleration in the direction of carriage travel during printing, due to return of the carriage or the like. As a result, the plate member 2 is easily moved by scanning of the carriage and thus becomes unstable.

After being molded to a predetermined shape, the flexible member 3 is welded to the opening of the housing 5. Since the flexible member 3 tends to be easily displaced, the predetermined shape of the flexible member 3 becomes unstable due to an increase or decrease in pressure inside the ink chamber 9 during manufacture, or due to vibration or drop during transport.

The negative pressure in the ink tank is generated by an elastic force of the spring member 1 through the plate member 2. If the shape of the flexible member 3 is unstable or the plate member 2 is displaced, it is difficult to keep the elastic force of the spring member 1 constant. This can cause an unstable internal pressure (negative pressure) in the ink tank. To achieve a stable negative pressure, it is necessary that the flexible member 3 be of a predetermined shape and the plate member 2 be located at a predetermined position. For example, to regulate the position of the plate member 2, the rib 7 integral with the lid member 4 is disposed around the periphery of the plate member 2. With the rib 7, the position of the plate member 2 can be regulated, the shape of the flexible member 3 can be stabilized, and thus a stable negative pressure can be maintained when the ink tank is mounted on the printer and printing is performed.

In the ink tank having a negative pressure generating mechanism realized by the flexible member 3, the plate member 2, and the spring member 1, there is provided a clearance between the rib 7 and the plate member 2 for manufacturability and stable movement of the plate member 2 associated with ink consumption.

U.S. Pat. No. 6,250,751 discloses a configuration in which a rib for regulating a plate member is integral with a housing and is provided around the entire periphery of the plate member. A flexible member is molded to substantially the same shape as the plate member. There is a clearance between the rib and the plate member. The flexible member between the plate member and the rib is caught by them when the plate member is moved by an external force applied to the ink tank. In this disclosed example, the flexible member is a thin film having a thickness as very small as about 30 to 100 μm. It is thus likely that the thin film caught between the plate member and the rib will be broken.

Japanese Patent Laid-Open No. 2007-062335 discloses a method in which, to reduce a force applied to a flexible member (film), the area of contact between a plate member and the flexible member is increased. To increase this area of contact, the outer edge of a plate member made of metal is bent at an obtuse angle or the shape of a plate member made of polymer is changed to form a curved surface. Additionally, there is disclosed a method in which shock caused by contact between a flexible film and a rib is reduced. To achieve this, the area of a part of the flexible film, the part on which a plate member is disposed, is made larger than the area of the plate member. Moreover, there is disclosed a method in which a part of a rib, the part with which a plate member strongly interferes, is shaped to avoid interference in a limited area.

The above-described methods are widely applicable regardless of the volume of the ink tank, and make it possible to reduce impact force and avoid collision in a limited area. However, in a configuration where the volume of ink is increased, a further improvement is desired because an increase in weight may cause unexpected problems if the ink tank is dropped or vibrated.

As for a configuration of an ink tank including an ink bag, Japanese Patent Laid-Open No. 2002-355988 discloses a means for preventing pressure changes in the ink bag caused by shaking during printing operation. In this disclosed example, since the ink bag has no negative pressure generating mechanism (including a spring and a plate member) therein, the ink bag is moved significantly by an inertial force of ink during printing operation. As a means for avoiding this, a plate member is placed over the entire area of the outer upper part of the ink bag such that the outer edge of the plate member is in contact with the inner wall of a container containing the ink bag. With this configuration, the plate member placed over the entire upper part of the ink bag can suppress movement of the ink bag. However, since the plate member is only placed on the ink bag, if an external pressure is applied to the ink tank, for example, due to vibration, drop, or the like during transport, the weight of the plate member may directly act on the entire ink bag. This may cause an increase in pressure inside the ink bag and lead to ink leakage from a supply port or the like.

SUMMARY OF THE INVENTION

The present invention has been proposed to solve the problems described above.

According to an aspect of the present invention, there is provided a liquid container including a housing having a first wall, a second wall opposite the first wall, a side wall connecting the first and second walls, and a supply port leading out liquid contained in the housing; a flexible member joined to part of the housing to form a liquid chamber; a spring member disposed in a space between the flexible member and the second wall; a plate member disposed between the spring member and the flexible member; and a rib member movably disposed in a space surrounded by the first wall and the flexible member, and configured to regulate a shape of the flexible member and a position of the plate member.

According to another aspect of the present invention, there is provided an ink tank including a flat main body having a first wall, a second wall opposite the first wall, a side wall connecting the first and second walls, and an ink supply port; a flexible film disposed inside the main body, attached to the main body to cover the first wall, configured to define an ink containing space with an inner surface of the main body, and displaced in a direction in which an inner volume of the ink containing space is reduced by consumption of ink; a plate-like member facing the ink containing space and attached to the flexible film; an elastic member disposed in the ink containing space and configured to generate a negative pressure; and a regulating member independently disposed between a side of the flexible film, the side being remote from the ink containing space, and the inner surface of the main body and configured to regulate displacement along a surface of the plate-like member.

Thus, kinetic energy applied to the plate member and the flexible member due to drop or external shock can be absorbed by the rib member (regulating member) movably and independently disposed inside the ink tank. Additionally, since the effects of shaking during carriage scanning can be reduced, deformation of the flexible member can be suppressed and a stable ink supply capability can be ensured. Thus, it is possible to provide a liquid container and ink tank with high reliability against vibration and drop during transport.

Since this configuration can reduce the size and weight of a rib member, it is possible to provide a highly reliable ink tank regardless of the volume of the ink tank.

Further features of the present invention will become apparent from the following description of exemplary embodiments with reference to the attached drawings.

DESCRIPTION OF THE EMBODIMENTS

Figure 1:
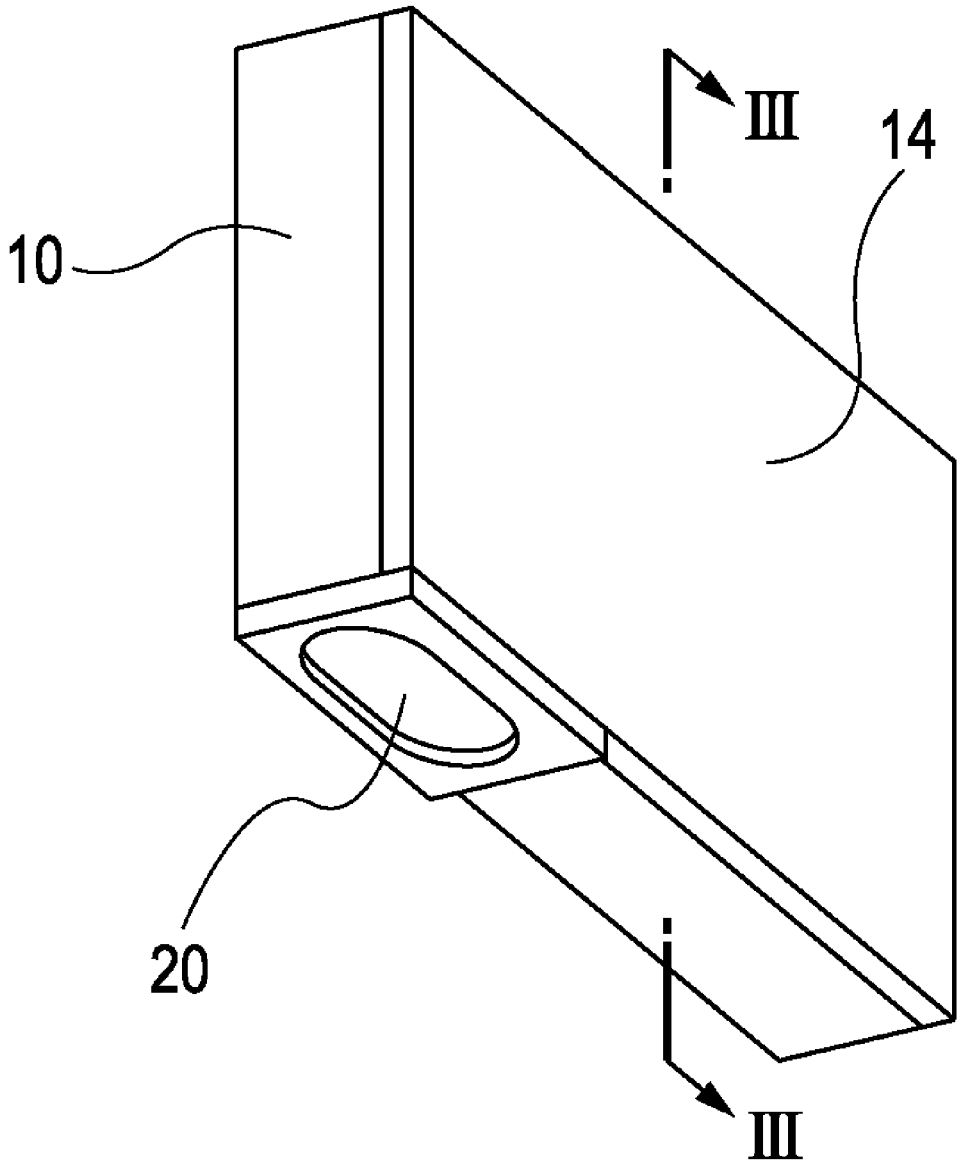
FIG. 1 illustrates an external configuration of an ink tank according to a first exemplary embodiment of the present invention.
Figure 2:
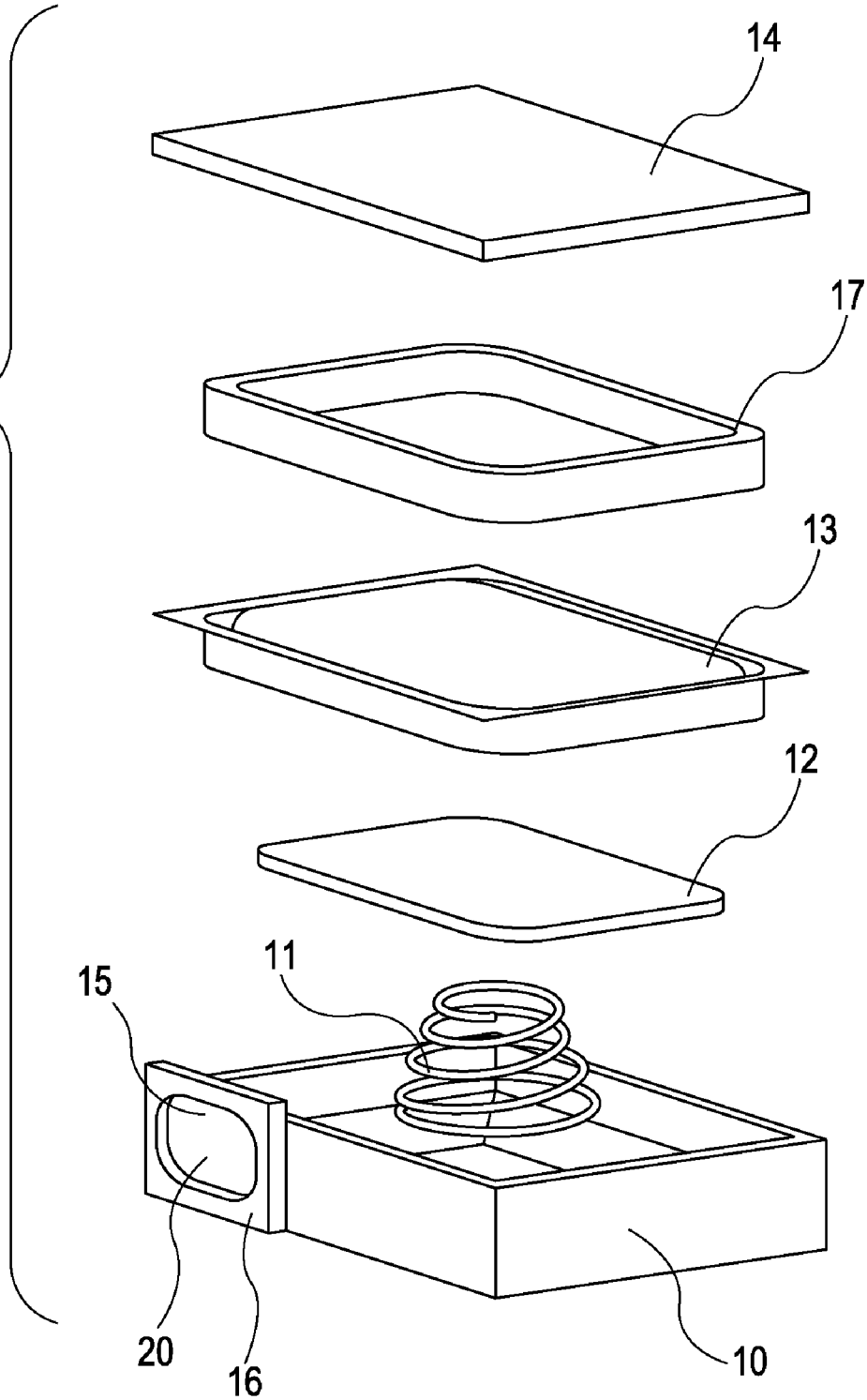
FIG. 2 is an exploded perspective view of the ink tank of FIG. 1.

FIG. 1 is a perspective view illustrating an external configuration of a liquid container (hereinafter referred to as ink tank) according to a first exemplary embodiment of the present invention. FIG. 2 is an exploded perspective view of the ink tank of FIG. 1.

The ink tank is a flat container containing ink. The ink tank has one wall (first wall), the other wall (second wall) opposite the first wall, and a side wall connecting the first and second walls. Externally, as illustrated in FIG. 1, a housing 10 and a lid member 14 are joined together to form a thin flat hexahedral main body of the ink tank, which is internally provided with an ink chamber 19 (also referred to as liquid chamber, see FIG. 3) serving as an ink containing space. The ink tank has a supply port 20 for supplying ink to a recording head (not shown). The supply port 20 is located at the bottom of the ink tank and faces downward in the direction of gravity when the ink tank is mounted on a printer.

As illustrated in FIG. 2, the ink tank includes the housing 10, a spring member 11, a plate member (also referred to as plate-like member) 12, a flexible member (hereinafter referred to as flexible film) 13, a lid member 14, a meniscus forming member 15, a retaining member 16, and a rib member 17.

The housing 10 has a thin flat shape and is open at one of the largest surfaces thereof. The housing 10 has the supply port 20 in its side wall. The supply port 20 is provided with the meniscus forming member 15. The retaining member 16 for attaching the meniscus forming member 15 to the housing 10 is provided outside the meniscus forming member 15. For example, the meniscus forming member 15 is a capillary member made of fabric material (e.g., polypropylene) and having a capillary force, or is a combination of such a capillary member and a filter member (having a permeability dimension of about 15 to 30 μm and made of stainless material, polypropylene, or the like). The meniscus forming member 15 communicates with the interior of the housing 10 through an ink passage (not shown). The meniscus forming member 15 forms an ink meniscus to prevent bubbles from entering the ink chamber 19 (described below) from outside.

The flexible film 13 formed into a predetermined shape is welded to the edge of the opening of the housing 10. The inner surfaces of the housing 10 and flexible film 13 define the ink chamber 19 serving as an ink containing space. Ink is injected into the ink tank at the final stage of construction of the ink tank. The flexible film 13 is, for example, a film member including a thin polypropylene film and having a thickness of about 20 to 120 μm. The negative pressure in the ink chamber 19 is generated when the plate member 12 attached to the flexible film 13 is biased by the spring member 11 toward the outside of the flexible film 13. The spring member 11 and the plate member 12 are made of stainless material in the present exemplary embodiment. However, the plate member 12 is not limited to this, and may be made of plastic material, such as polypropylene or Noryl. The lid member 14 is attached to the opening of the housing 10. This protects the flexible film 13 convex outward and, at the same time, prevents ink in the ink chamber 19 from evaporating. The lid member 14 has an air communication part (not shown) for allowing atmospheric pressure to be present outside the ink chamber 19.

When ink in the ink chamber 19 is consumed by being supplied to the recording head, the spring member 11 contracts and allows the plate member 12 to move along the rib member 17 and, at the same time, allows the flexible film 13 to bend. Thus, the inner volume of the ink chamber 19 is reduced. The plate member 12 is configured such that ink in the ink chamber 19 can be consumed until the plate member 12 comes into contact with the inner surface of the housing 10. The rib member 17 is a single independent tubular member extending continuously along all the four sides of the plate member 12. In a space surrounded by the lid member 14 and the flexible film 13, the rib member 17 is movably and displaceably disposed in such a manner that it covers the outer edge of the plate member 12. The rib member 17 thus can regulate the position of the plate member 12 and the shape of the flexible film 13.

Figure 3:
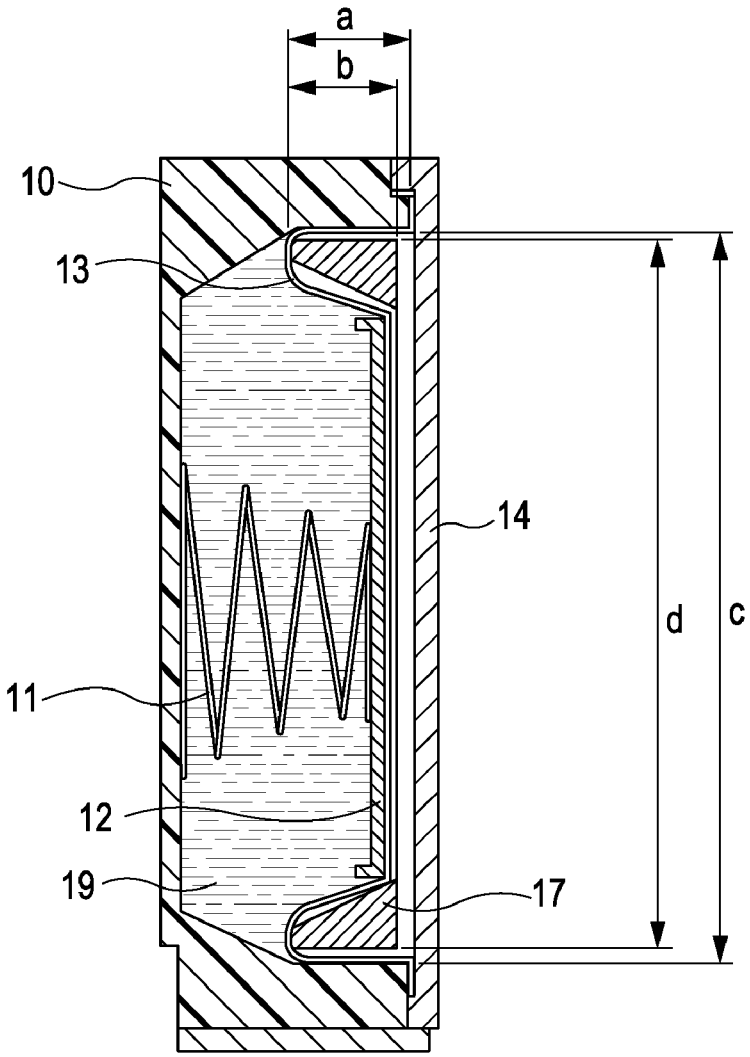
FIG. 3 is a cross-sectional view taken along line III-III of FIG. 1.

FIG. 3 is a schematic cross-sectional view taken along line III-III of FIG. 1, which illustrates the ink tank of the present exemplary embodiment. As illustrated in FIG. 3, the shape of the flexible film 13 and the position of the plate member 12 are regulated by the rib member 17 in the ink tank. The rib member 17 serves as a regulating member in that it regulates the shape of the flexible film 13 and the position and movement of the plate member 12. The rib member 17 is configured such the relationship a>b is satisfied, where "a" is the distance between the inner surface of the lid member 14 and an end of the rib member 17 remote from the lid member 14 and "b" is the height of the rib member 17 (i.e., the distance between a base of the rib member 17 adjacent to the lid member 14 and the end of the rib member 17 remote from the lid member 14). When the relationship a>b is satisfied, even if the lid member 14 is bent by an external force applied thereto, the lid member 14 can be prevented from coming into contact with the rib member 17. The external force can thus be prevented from being exerted on the ink chamber 19 through the rib member 17 and causing ink leakage. A clearance between the lid member 14 and the rib member 17 can be set to any value depending on the strength of the lid member 14 and the amount of external force exerted, and is not limited to a specific value. In the present exemplary embodiment, a clearance of 0.5 to 2.0 mm is provided between the lid member 14 and the rib member 17 to prevent ink leakage caused by an external force. The outer diameter "d" of the rib member 17 is set to be smaller than the distance "c" between parts of the flexible film 13, the parts being in contact with respective opposite sides of the inner surface of the housing 10. Since the flexible film 13 is extremely thin, the distance "c" is practically the same as the distance between opposite sides of the inner surface of the housing 10. In the space surrounded by the flexible film 13 and the lid member 14, the rib member 17 is not secured to any member. Thus, the rib member 17 can move freely within the clearance relative to the other members.

Figure 4:
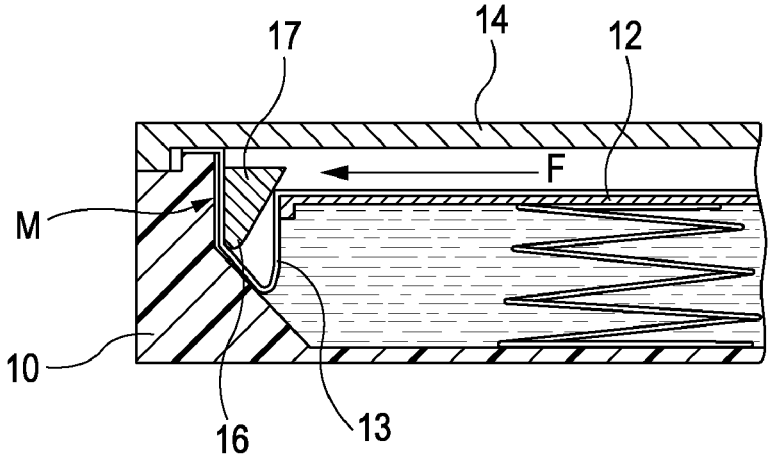
FIG. 4 is an enlarged view illustrating part of an interior of the ink tank of FIG. 1 to which a shock is applied when the ink tank is dropped or vibrated.

FIG. 4 is an enlarged view illustrating part of the interior of the ink tank to which a shock is applied when the ink tank is dropped or vibrated during transport. For example, the flexible film 13 and the plate member 12 are moved in a direction F in which an inertial force generated when the ink tank is dropped acts. The flexible film 13 is thus caught between the rib member 17 and the plate member 12. However, as the flexible film 13 and the plate member move, the rib member 17 configured to be freely movable in the space surrounded by the flexible film 13 and the lid member 14 also moves. Therefore, a pressure (impact force) exerted on the flexible film 13 by the plate member 12 and the rib member 17 can be reduced by a shock-absorbing effect provided by the movement of the rib member 17. That is, while moving, the rib member 17 absorbs kinetic energy of the plate member 12 moved by an inertial force. Thus, the pressure exerted on the flexible film 13 by the plate member and the rib member 17 can be reduced.

Additionally, when the rib member 17 disposed in the space surrounded by the flexible film 13 and the lid member 14 is remote from the plate member 12, the impact force described above is attenuated. This is because of the long distance between the rib member 17 and the plate member and the long time taken for the rib member 17 and the plate member 12 to come into collision with each other. Thus, the pressure exerted on the flexible film 13 can be reduced.

In FIG. 4, the housing 10 and the flexible film 13 seem to be in close contact with each other in a region M. However, ink may flow into the region M between the housing 10 and the flexible film 13. This further enhances the shock-absorbing effect described above.

It is thus made possible to effectively prevent the flexible film 13 from being damaged due to drop and vibration during transport. Additionally, since the rib member 17 is configured independently of the other members, the selection of the material of the rib member 17 is not limited by the selection of materials of the other members. Therefore, a lightweight material having high shock-absorbing properties can be selected as a material of the rib member 17. For greater strength against drop and vibration, it is desirable that the rib member 17 be made of flexible elastic material, such as elastomer or foam.

A second exemplary embodiment of the present invention will now be described with reference to FIG. 5 and FIG. 6. The second exemplary embodiment differs from the first exemplary embodiment in configuration of the rib member. In the second exemplary embodiment, components identical to those of the first exemplary embodiment are given the same reference numerals and their description will be omitted.

Figure 5:
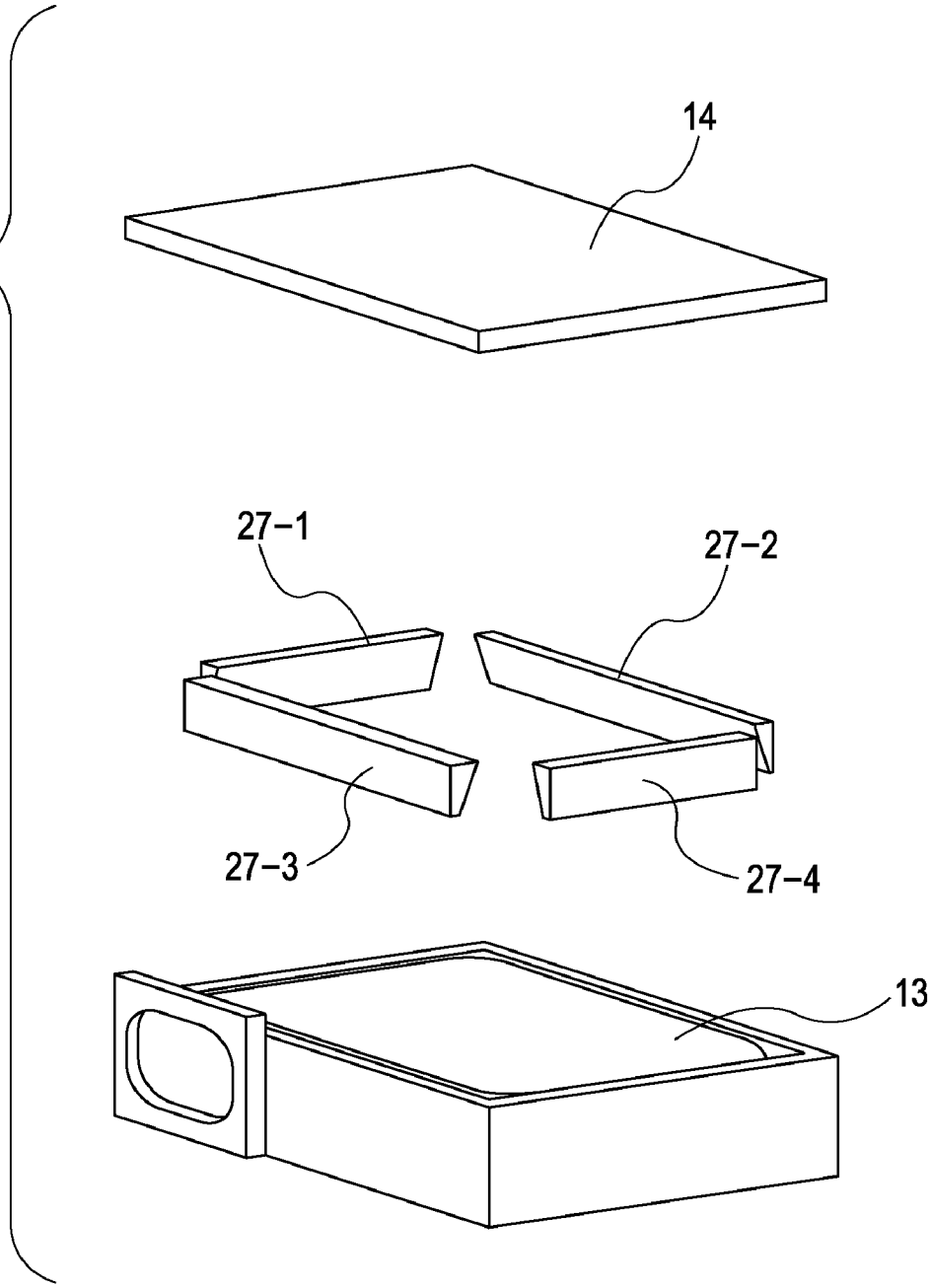
FIG. 5 is an exploded perspective view of an ink tank according to a second exemplary embodiment of the present invention.
Figure 6:
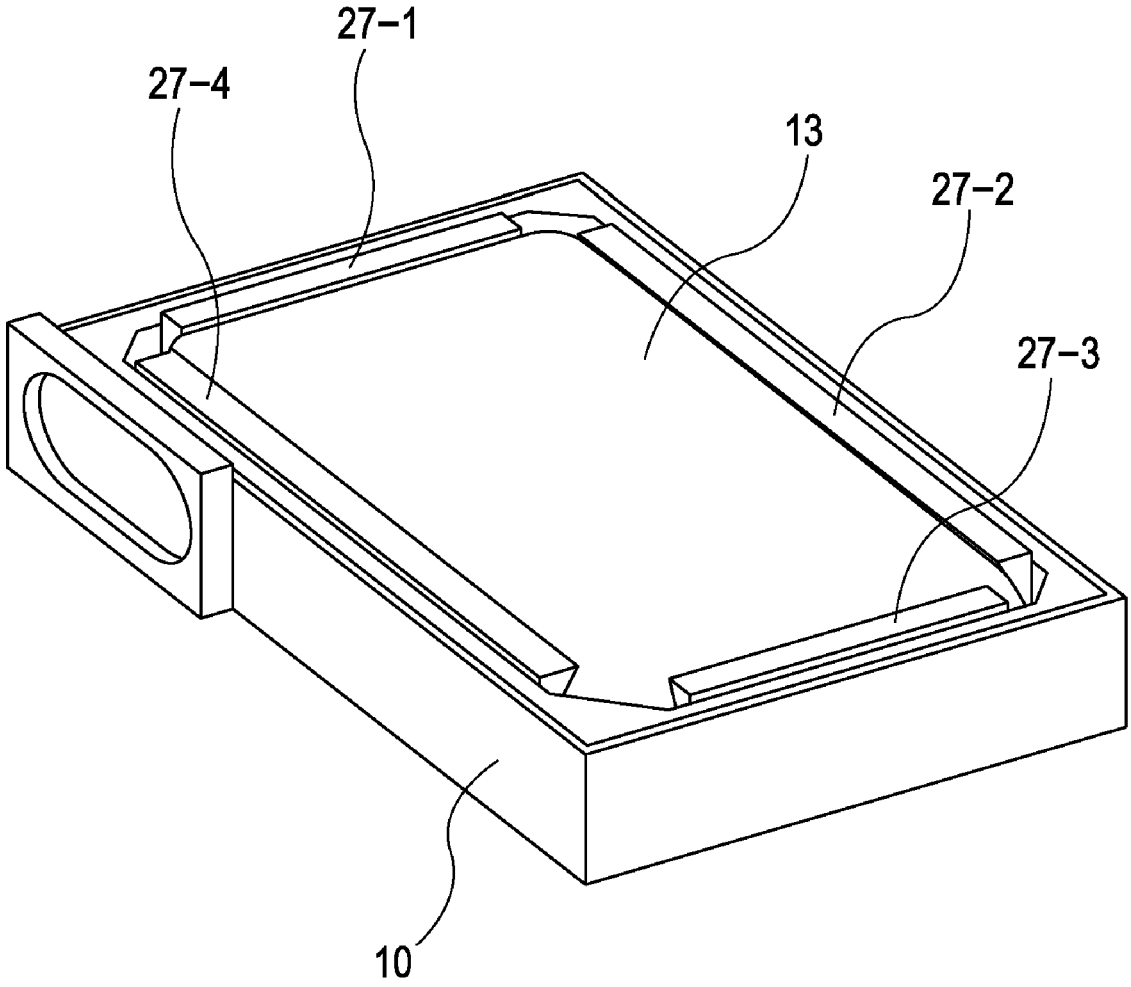
FIG. 6 illustrates a state where a rib member is mounted in the ink tank of FIG. 5.

FIG. 5 is an exploded perspective view of an ink tank according to the second exemplary embodiment. In the present exemplary embodiment, a rib member is divided into two or more sub-members. In the example of FIG. 5, there are four independent sub-members (rib members 27-1 to 27-4) corresponding to respective four sides of the plate member 12. As illustrated in FIG. 6, the rib members 27-1 to 27-4 at positions facing the respective four sides of the periphery of the plate member 12 are mounted on the flexible film 13. As in the case of the first exemplary embodiment, the spring member 11 and the plate member 12 are disposed inside the ink chamber 19 covered with the flexible film 13 illustrated in FIG. 5 and FIG. 6.

Figure 7:
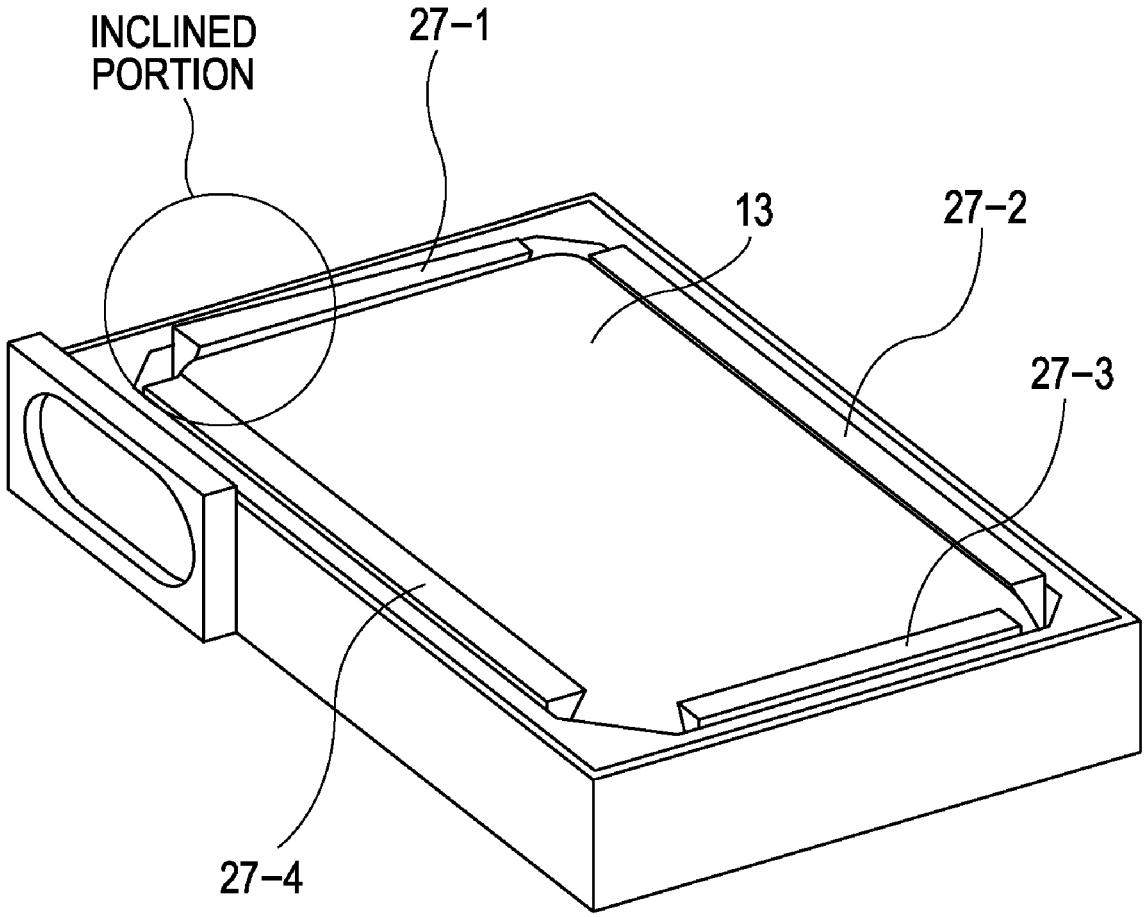
FIG. 7 illustrates a state of the rib member in the ink tank according to the second exemplary embodiment.

Unlike the rib member 17 of the first exemplary embodiment, the rib member, which is divided into a plurality of independent sub-members, cannot be supported by itself. If pressure in the ink chamber 19 is reduced in the ink injection process or the like, the rib member may fall onto the flexible film 13. To prevent this, in the second exemplary embodiment, ink is injected after the flexible film 13 is welded to the housing 10 so that the convex molded shape of the flexible film 13 can be maintained. Then, after the rib member is mounted on the flexible film 13, the lid member 14 is welded to the housing 10. As compared to an integral rib member, the rib member composed of a plurality of independent sub-members can more closely follow the movement of the plate member 12 that moves by inertial force, and thus can achieve a greater shock-absorbing effect. To regulate the shape of the flexible film 13 and the position of the plate member 12, it is necessary that the rib member be disposed around substantially the entire periphery of the plate member 12. As illustrated in FIG. 7, a sub-member (e.g., rib member 27-1) of the rib member may be inclined due to the convex and concave shape of the flexible film 13. However, since the rib member is composed of a plurality of independent sub-members, the other sub-members (rib members 27-2 to 27-4) can be mounted on the flexible film 13 without being affected by the inclined rib member 27-1, and thus can accurately regulate the position and shape of the flexible film 13.

In the present exemplary embodiment, it is desirable that the rib member be highly elastic to provide a necessary shock absorbing capability. At the same time, it is desirable that the rib member be lightweight to be configured independently of the other members. Although elastomer, rubber material, foam, or the like may be used to meet such requirements, the rib member may be of any material that meets the requirements of the present configuration.

A third exemplary embodiment of the present invention will now be described with reference to FIG. 8 and FIG. 9. The third exemplary embodiment differs from the first and second exemplary embodiments in configuration of the rib member. In the third exemplary embodiment, components identical to those of the first exemplary embodiment are given the same reference numerals and their description will be omitted.

Figure 8:
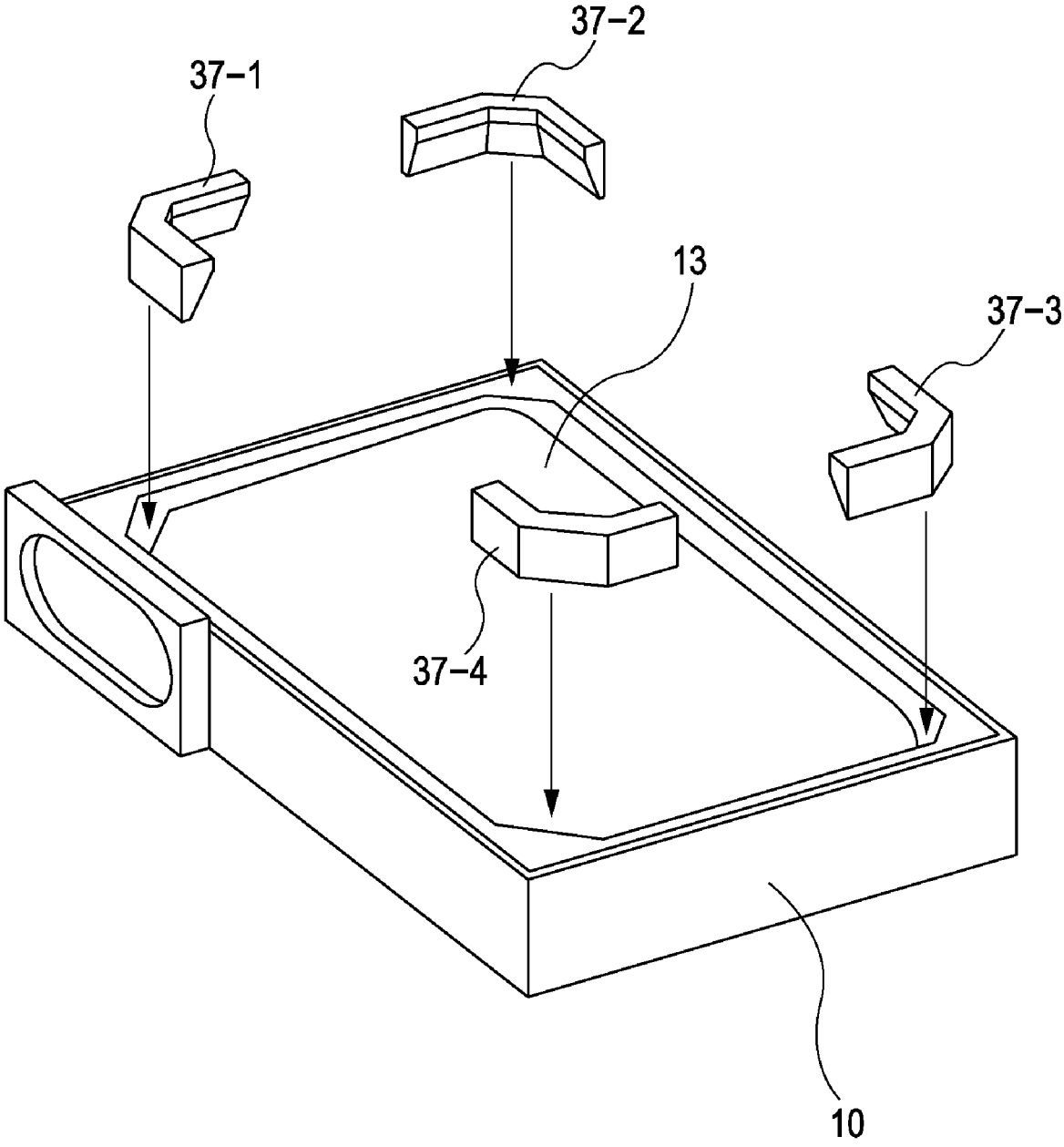
FIG. 8 is an exploded perspective view of an ink tank according to a third exemplary embodiment of the present invention.
Figure 9:
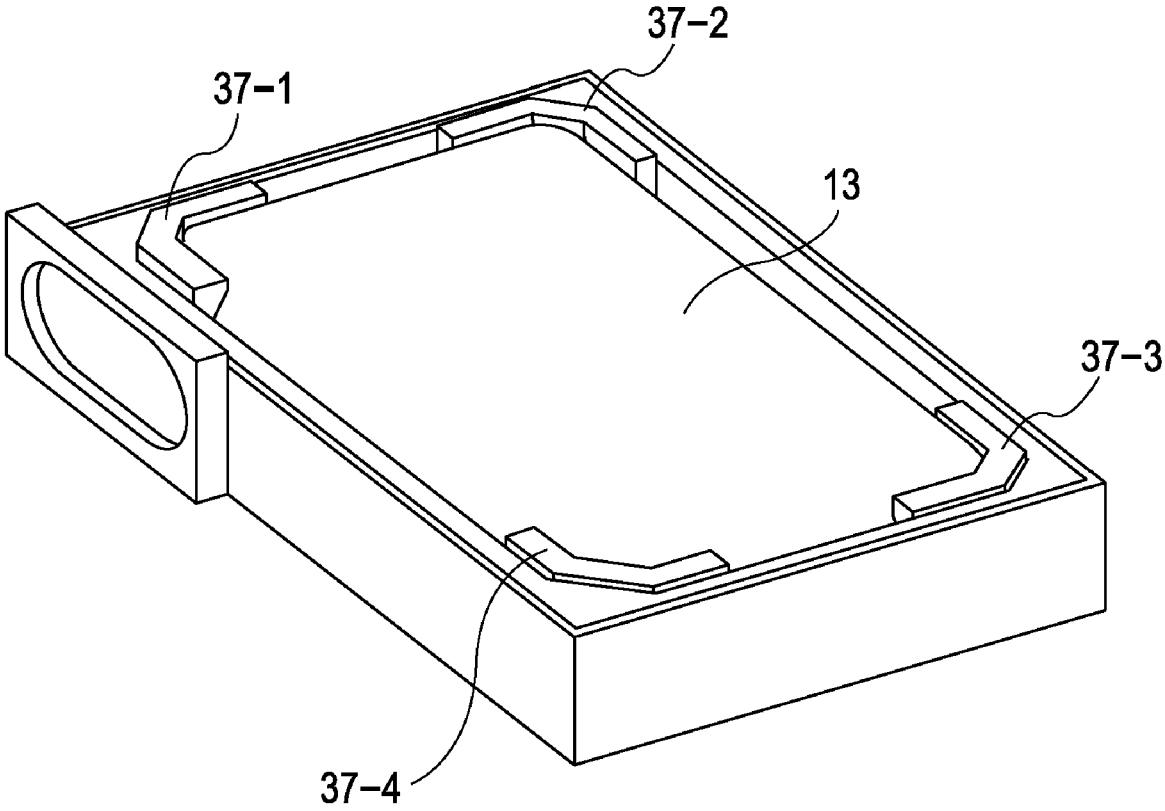
FIG. 9 illustrates a state in which a rib member is mounted in the ink tank of FIG. 8.
Figure 10:
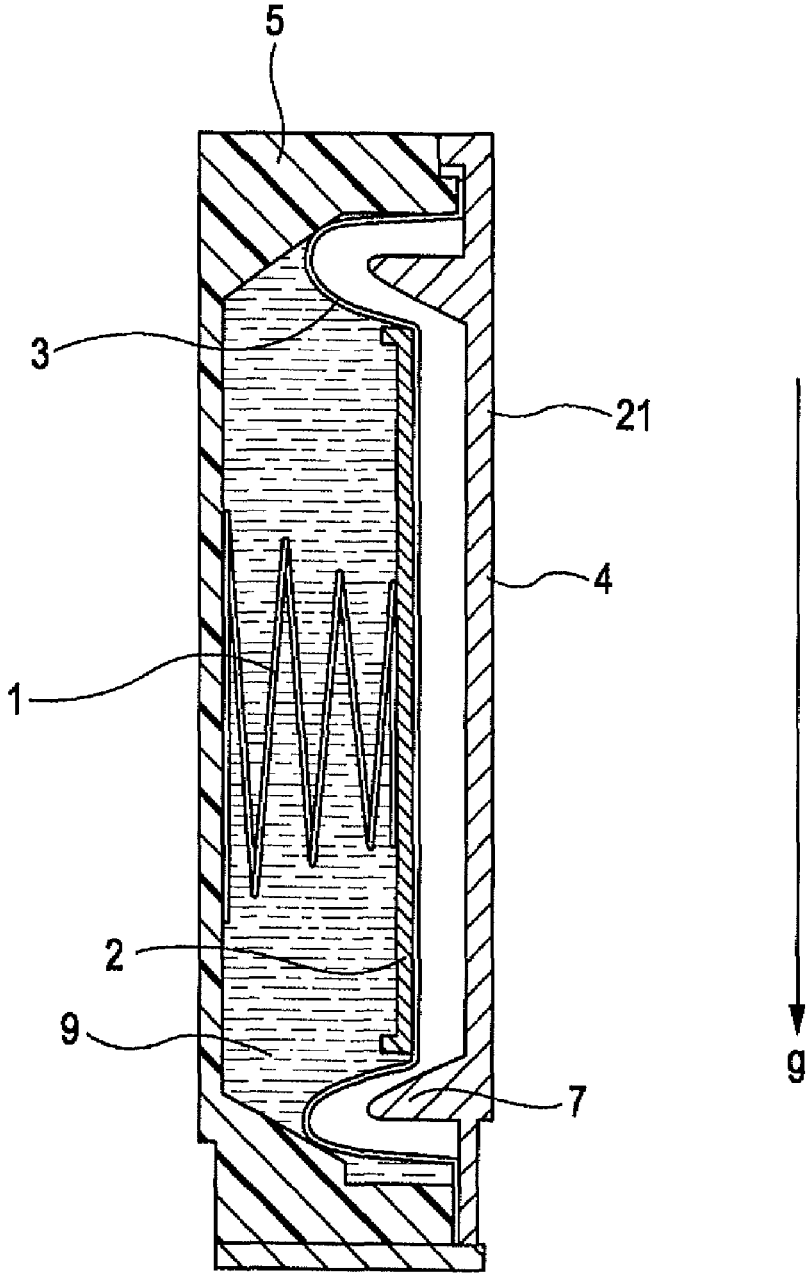
FIG. 10 (PRIOR ART)
FIG. 10 schematically illustrates a configuration of a known ink tank.

FIG. 8 is an exploded perspective view of an ink tank according to the third exemplary embodiment. FIG. 9 illustrates an interior of the ink tank in which a rib member is mounted at a predetermined position. As in the case of the first and second exemplary embodiments, the spring member 11 and the plate member 12 are disposed inside the ink chamber 19 covered with the flexible film 13 illustrated in FIG. 8 and FIG. 9.

The present exemplary embodiment is obtained by modifying the rib member of the second exemplary embodiment. The rib member is divided into four independent sub-members (rib members 37-1 to 37-4), which are disposed at positions facing respective four corners of the periphery of the plate member 12 in the ink tank. Each of the rib members 37-1 to 37-4 is bent in an L-shape and extends along both sides of the corresponding corner of the plate member 12. The flexible film 13 retains its greatest shape rigidity obtained by molding at the four corners on which the rib members 37-1 to 37-4 are to be mounted, as illustrated in FIG. 8. Therefore, the flexible film 13 tends to be deformed after ink injection. In the present exemplary embodiment, as described above, the rib members 37-1 to 37-4 are mounted on the respective four corners where the flexible film 13 tends to be deformed. This allows reliable correction of the shape of the flexible film 13. At the same time, if the ink tank is dropped or shocked, the rib member can closely follow the movement of the plate member 12.

The plate member 12 in the ink tank has long sides and short sides. However, the four sub-members (rib members 37-1 to 37-4) of the rib member are identical, as they are mounted at the respective four corners of the plate member 12. This is advantageous in reducing component costs. As in the case of the other exemplary embodiments, the rib member may be of any material that can provide necessary shock-absorbing capability.

Thus, the third exemplary embodiment provides an excellent shock-absorbing effect, high manufacturability, and lower costs.

Alternatively, in the present invention, the configuration of the second exemplary embodiment may be combined with that of the third exemplary embodiment. This makes it possible to provide a more reliable shock-absorbing effect.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-017838 filed Jan. 29, 2008, which is hereby incorporated by reference herein in its entirety.

What is claimed is:

1. A liquid container comprising:

a housing having a first wall, a second wall opposite the first wall, a side wall connecting the first and second walls, and a supply port leading out liquid contained in the housing;

a flexible member joined to a part of the housing to form a liquid chamber;

a spring member disposed in a space between the flexible member and the second wall;

a plate member disposed between the spring member and the flexible member; and a rib member being not fixed to the first wall and movably disposed in a space surrounded by the first wall and the flexible member, and configured to regulate a shape of the flexible member and a position of the plate member.

2. The liquid container according to claim 1, wherein the rib member is disposed between the plate member and the housing, faces a periphery of the plate member, and extends continuously around the entire periphery of the plate member.

3. The liquid container according to claim 1, wherein the rib member is divided into two or more sub-members.

4. The liquid container according to claim 1, wherein the rib member is disposed between the plate member and the housing, and divided into sub-members located at respective positions facing corresponding sides of a periphery of the plate member.

5. The liquid container according to claim 1, wherein the rib member is disposed between the plate member and the housing, and divided into sub-members located at respective positions facing corresponding corners of a periphery of the plate member.

6. The liquid container according to claim 1, wherein the rib member is disposed between an inner surface of the first wall and the flexible member, and wherein a predetermined clearance is defined between the rib member and the flexible member or between the rib member and the inner surface of the first wall.

7. The liquid container according to claim 1, wherein the rib member is a flexible elastic member.

8. The liquid container according to claim 1, wherein the rib member is made of foam.

9. An ink tank comprising:

a flat main body having a first wall, a second wall opposite the first wall, a side wall connecting the first and second walls, and an ink supply port;

a flexible film disposed inside the main body, attached to the main body to cover the first wall, configured to define an ink containing space with an inner surface of the main body, and displaced in a direction in which an inner volume of the ink containing space is reduced by consumption of ink;

a plate-like member facing the ink containing space and attached to the flexible film;

an elastic member disposed in the ink containing space and configured to generate a negative pressure; and a regulating member being not fixed to the first wall and movably disposed between a side of the flexible film, the side being remote from the ink containing space, and the inner surface of the main body and configured to regulate displacement along a surface of the plate-like member.

10. The ink tank according to claim 9, wherein the regulating member extends continuously along four sides of the plate-like member.

11. The ink tank according to claim 9, wherein the regulating member is divided into two or more sub-members.

12. The ink tank according to claim 9, wherein the regulating member has four independent sub-members corresponding to respective four sides of the plate-like member.

13. The ink tank according to claim 9, wherein the regulating member has four independent sub-members corresponding to respective four corners of the plate-like member.

14. The ink tank according to claim 9, wherein the regulating member is a flexible elastic member.

15. The ink tank according to claim 9, wherein the regulating member is made of foam.

16. A liquid container comprising:

a housing having a first wall, a second wall opposite the first wall, a side wall connecting the first and second walls, and a supply port leading out liquid contained in the housing;

a flexible member joined to a part of the housing to form a liquid chamber;

a spring member disposed in a space between the flexible member and the second wall;

a plate member disposed between the spring member and the flexible member; and a rib member configured independently of the first wall and movably disposed in a space surrounded by the first wall and the flexible member, and configured to regulate a shape of the flexible member and a position of the plate member.

17. An ink tank comprising:

a flat main body having a first wall, a second wall opposite the first wall, a side wall connecting the first and second walls, and an ink supply port;

a flexible film disposed inside the main body, attached to the main body to cover the first wall, and configured to define an ink containing space with an inner surface of the main body, and displaced in a direction in which an inner volume of the ink containing space is reduced by consumption of ink;

a plate-like member facing the ink containing space and attached to the flexible film;

an elastic member disposed in the ink containing space and configured to generate a negative pressure; and a regulating member configured independently of the first wall and movably disposed between a side of the flexible film, the side being remote from the ink containing space, and the inner surface of the main body and configured to regulate displacement along a surface of the plate-like member.

* * * * *